US010301767B2

(12) United States Patent
Valiyambath Krishnan et al.

(10) Patent No.: US 10,301,767 B2
(45) Date of Patent: May 28, 2019

(54) GARMENT STEAMING APPLIANCE

(71) Applicant: KONINKLIJKE PHILIPS N.V., Eindhoven (NL)

(72) Inventors: Mohankumar Valiyambath Krishnan, Eindhoven (NL); Milind Vishwas Date, Eindhoven (NL); Willilam Wai Lik Wong, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/521,952

(22) PCT Filed: Oct. 29, 2015

(86) PCT No.: PCT/EP2015/075050
§ 371 (c)(1),
(2) Date: Apr. 26, 2017

(87) PCT Pub. No.: WO2016/066725
PCT Pub. Date: May 6, 2016

(65) Prior Publication Data

US 2017/0314184 A1 Nov. 2, 2017

(30) Foreign Application Priority Data

Oct. 31, 2014 (EP) ..... 14191273

(51) Int. Cl.
*D06F 75/20* (2006.01)
*D06F 75/38* (2006.01)

(52) U.S. Cl.
CPC ..... *D06F 75/20* (2013.01); *D06F 75/38* (2013.01)

(58) Field of Classification Search
CPC ..... D06F 75/00; D06F 75/24; D06F 75/36; D06F 75/38
See application file for complete search history.

(56) References Cited

U.S. PATENT DOCUMENTS 2,750,690 A * 6/1956 Gomersall ..... D06F 75/18 38/77.9
2,793,448 A 5/1957 Duncanson
2,813,358 A * 11/1957 Ivar ..... D06F 75/18 38/77.7

(Continued)

FOREIGN PATENT DOCUMENTS

CA 780209 A 3/1968
EP 1559830 A1 8/2005

(Continued)

*Primary Examiner* — Ismael Izaguirre

(57) ABSTRACT

The invention relates to a garment steaming appliance comprising a sole plate assembly (1) comprising a steam channel (6) for receiving a flow of steam, an ironing plate (3) comprising an ironing surface (4) and an opposing upper surface, wherein the steam channel (6) extends along the upper surface of the ironing plate (3), and a vent (7) extending through said ironing plate (3) from said steam channel (6) to said ironing surface (4). The steam channel (6) is configured to divide the flow of steam into multiple flow paths that reconverge above said vent (7) from different directions to control the direction of the resultant flow of steam out of said vent (7) relative to said ironing surface (4).

14 Claims, 4 Drawing Sheets

(56) References Cited

U.S. PATENT DOCUMENTS

| | | | | | |
|---|---|---|---|---|---|
| 3,248,813 | A * | 5/1966 | Quick | D06F 75/12 | 239/590 |
| 3,811,208 | A * | 5/1974 | Vieceli | D06F 75/14 | 38/77.8 |
| 3,820,259 | A * | 6/1974 | Davidson et al. | D06F 75/18 | 38/77.5 |
| 3,872,613 | A * | 3/1975 | Davidson | D06F 75/18 | 38/77.83 |
| 4,594,800 | A | 6/1986 | Herrmann | | |
| 5,979,089 | A * | 11/1999 | Bouleau | D06F 75/20 | 38/77.83 |
| 8,464,445 | B2 | 6/2013 | Jiang | | |
| 2007/0193076 | A1 | 8/2007 | Jiang | | |
| 2008/0040954 | A1 | 2/2008 | Yu et al. | | |
| 2010/0299975 | A1 * | 12/2010 | Thomas | D06F 75/10 | 38/77.83 |
| 2012/0042547 | A1 | 2/2012 | Pang | | |

FOREIGN PATENT DOCUMENTS

| | | | |
|---|---|---|---|
| EP | 1801281 | A1 | 6/2007 |
| GB | 799388 | A | 8/1958 |

* cited by examiner

GARMENT STEAMING APPLIANCE

This application is the U.S. National Phase application under 35 U.S.C. § 371 of International Application No. PCT/EP2015/075050, filed on Oct. 29, 2015, which claims the benefit of International Application No. 14191273.3 filed on Oct. 31, 2014. These applications are hereby incorporated by reference herein.

FIELD OF THE INVENTION

The present invention relates to a garment steaming appliance such as an iron or hand-held steamer.

BACKGROUND OF THE INVENTION

Garment steaming appliances, such as steam irons, have vents for the passage of steam out of the iron towards a garment being steamed. Steam is directed along a steam channel formed in a sole plate towards the vents. The jet of steam emitted from the vents is preferred to have a directionality which is substantially perpendicular to the ironing surface of the sole plate for good ironing results.

However, it is becoming more common to provide steaming appliances having a sole plate which is (very) thin and of low mass. For example, FIG. 1 shows a cross-sectional elevation through such a thin sole plate assembly 1 having a sole plate 2 and an ironing plate 3 with an ironing surface 4 that is applied to garments to be ironed. The ironing plate 3 forms part of the sole plate assembly 1 and may be integral with the sole plate 2 or separate and detachable therefrom for ease of manufacture. The sole plate 2 is provided with a recess 5 in its lower surface that forms a steam channel 6. Steam is directed from a steam chamber (not shown) along the steam channel 6 in a generally horizontal direction, as indicated by arrow "A". The steam is travelling along the steam channel 6 in a direction substantially parallel to the ironing surface 4. Vents 7 are formed in the ironing pate 3 so that the steam passes through vents 7 and out of the appliance onto a garment being ironed. The vents 7 may have an average length in a direction across the ironing plate 3 of less than 5 mm, and may even have a length which is five times less than their major dimension such as their diameter. However, when the ironing plate 3 is relatively thin, the steam is emitted at an angle more towards a horizontal direction, as indicated by arrow 'B', which results in less efficient ironing. In other words, this type of sole plate 2 results in the jet of steam being emitted from the steam vents 7 with a substantial component of motion in a direction that corresponds to its original direction of motion prior to passing into the vents 7. This causes steam to flow from the ironing surface 4 in a substantially sideways direction or in a direction towards the front or rear of the iron.

OBJECT AND SUMMARY OF THE INVENTION

It is an object of the invention to provide a garment steaming appliance which substantially alleviates or overcomes the problems mentioned above.

The invention is defined by the independent claims. The dependent claims define advantageous embodiments.

According to the present invention, there is provided a garment steaming appliance comprising a steam channel for receiving a flow of steam, an ironing plate comprising an ironing surface and an opposing upper surface, wherein the steam channel extends along the upper surface of the ironing plate, and a vent extending through said ironing plate from said steam channel to said ironing surface, characterised in that the steam channel is configured to divide the flow of steam into multiple flow paths that reconverge above said vent from different directions to control the direction of the resultant flow of steam out of said vent relative to the ironing surface.

Since the steam channel is configured to divide or split the flow of steam into different paths that reconverge on the vent from different directions, the velocity component of the flow in the direction of steam motion in the steam channel is greatly reduced prior to the flow passing through the vent and out of the sole plate assembly. As a result, the direction of the jet of steam is controlled to be in a pre-determined direction compared to the ironing surface.

In a preferred embodiment, the steam channel is configured so that the direction of the resultant flow of steam is substantially perpendicular relative to the ironing surface. This ensures that the steam emitted from the sole plate assembly is used to its maximum efficiency.

In preferred embodiments, the appliance comprises a baffle in the steam channel that partially surrounds the vent to divide the flow of steam into multiple flow paths.

In a preferred embodiment the baffle may be configured to divert steam into at least two separate flow paths that converge on said vent from opposite directions.

The steam may be divided such that each flow path contains the same quantity or intensity of steam. If there are two separate flow paths, it is preferable if they are located diametrically opposite each other so that the resultant velocity component of the steam when the separate flow paths converge is substantially zero. By configuring the baffle in this way, the velocity component of the flow is practically or completely cancelled out above the vent and prior to passing through the ironing plate.

Each baffle may comprise separate sections. If so, each section is spaced from its other sections and surrounds a vent. This controls the flow of steam into a region above the vent.

At least some of said sections forming the baffle are arc-shaped. This encourages a smooth flow of steam around the baffles.

In some embodiments, there may be multiple vents and a separate baffle may be associated with each vent or a baffle may be associated with a group of vents so as to maximise flow of steam towards and into the vents.

In a preferred embodiment, the sole plate assembly comprises a sole plate extending over the ironing plate. In this case, the steam channel can be formed from a recess in said sole plate over which the ironing plate extends and the vent is formed in the ironing plate.

The sole plate and the ironing plate can be integrally formed or can separate components attachable to each other for ease of manufacture and maintenance.

The baffles are preferably located in the recess between the sole plate and the ironing plate. They may be integrally formed from the sole plate, the ironing plate, or both.

If the baffles are integral with the sole plate, then it is preferable for a seal to be formed between an upper end of the baffle and the ironing plate to which it extends. Similarly, if the baffles are integral with the ironing plate, then it is preferable for a seal be formed between an upper end of the baffle and the sole plate to which it extends. In either case, this ensures that no steam can pass over the top of the baffle, but can only flow around it.

In a preferred embodiment, the seal is formed from ceramic, polymer or elastomeric material.

These and other aspects of the invention will be apparent from and elucidated with reference to the embodiments described hereinafter.

BRIEF DESCRIPTION OF THE DRAWINGS

Embodiments of the invention will now be described, by way of example only, with reference to FIGS. 2 to 7 of the accompanying drawings, in which.

DETAILED DESCRIPTION OF THE EMBODIMENTS

Figure 1:
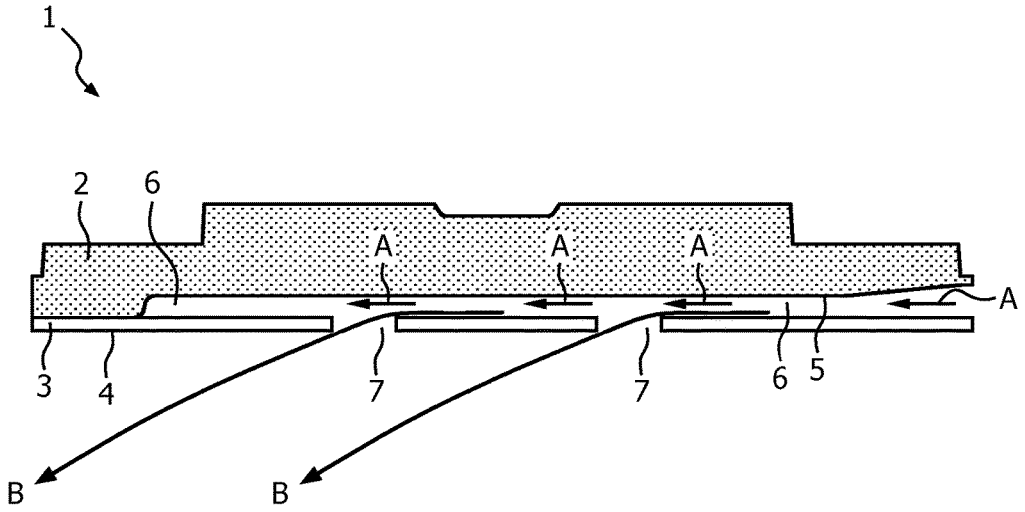
FIG. 1 shows a cross-sectional side elevation through a thin sole plate assembly of a garment steaming appliance, showing jets of steam exiting the sole plate at an angle.
Figure 2:
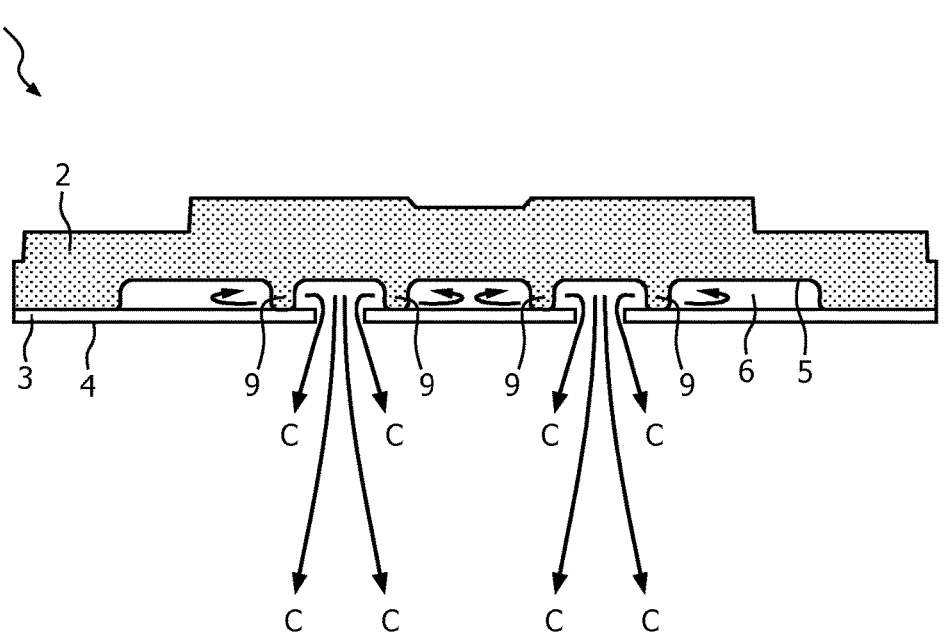
FIG. 2 shows a cross-sectional side elevation through a sole plate according to an embodiment of the present invention.

FIG. 2 depicts an embodiment of the present invention. In this embodiment, there is provided a garment steaming appliance having a sole plate assembly 1. The structure of the sole plate assembly 1 of FIG. 2 according to the invention is based on the structure of the sole plate assembly 1 depicted in FIG. 1. The sole plate assembly 1 according to the invention comprises a steam channel 6 for receiving a flow of steam, an ironing plate 3 comprising an ironing surface 4, and a vent 7 extending through said ironing plate 3 from said steam channel 6 to said ironing surface 4. The steam channel 6 is configured to divide the flow of steam into multiple flow paths that reconverge above said vent 7 from different directions to control the direction of the resultant flow of steam out of said vent 7 relative to said ironing surface 4.

The direction of steam emitted from the sole plate assembly 1 is controlled so that it comes out of the sole plate assembly 1 at a pre-determined angle compared to the ironing surface 4. Preferably, this angle is between 60 and 90 degrees. In the most preferred embodiment the steam direction is perpendicular or substantially perpendicular (i.e. 90 degrees +/−20%) relative to the ironing surface 4 which is applied to garments during ironing.

The sole plate 2 is provided with a recess 5 in its lower surface that forms a steam channel 6. Steam is directed from a steam chamber (not shown) along the steam channel 6 in a generally horizontal direction, as indicated by arrow "A". However, according to an embodiment of the present invention, a baffle 9 is provided in the steam channel 6 that extends for the full height of the recess 5 so that steam flowing along the channel 6 is diverted (or split) into multiple flow paths prior to reaching the vents 7. Steam flowing along the channel 6 maintains its horizontal flow direction on parts of the steam channel where no baffle 9 is provided. The baffle 9 is formed so that the steam following the multiple flow paths reconverges or collides in the steam channel above the upper end of the vent 7 from multiple directions. This serves to reduce, cancel out or balance, any horizontal vector components in the opposing steam flows prior to the steam entering the vent 7 so that the steam then flows directly through the vent 7 and exits the vent 7 in a direction substantially perpendicular to the ironing surface 4 of the ironing plate 3, as shown by arrows 'C'. In other words, the baffles 9 act as steam flow diverters. As shown in FIG. 2, the flow of steam begins to fan out as it leaves the steam vent 7 and as it encounters the outside air, and assumes a generally conical shape substantially perpendicular to the ironing surface 4.

In a preferred embodiment, the baffles 9 are designed such that steam reaches the vent 7 from two or more opposing directions, which results in reduction or cancellation of the velocity components in the directions of the steam flow in the steam channel 6 so that the resulting jet from the steam vent 7 has a velocity component substantially perpendicular to the ironing surface 4. The horizontal vector component is a resultant of the velocity components of the opposing steam flow components in the steam channel 6 just prior to the steam entering a vent 7. If the steam flows are each of the same intensity, then a balanced cancellation of the horizontal velocity component of the steam flows occurs above the vent 7. Preferably, the resultant horizontal vector component is reduced to zero or is at a negligible level so that the jet coming out of the steam vent 7 is substantially perpendicular to the ironing surface 4.

Figure 3:
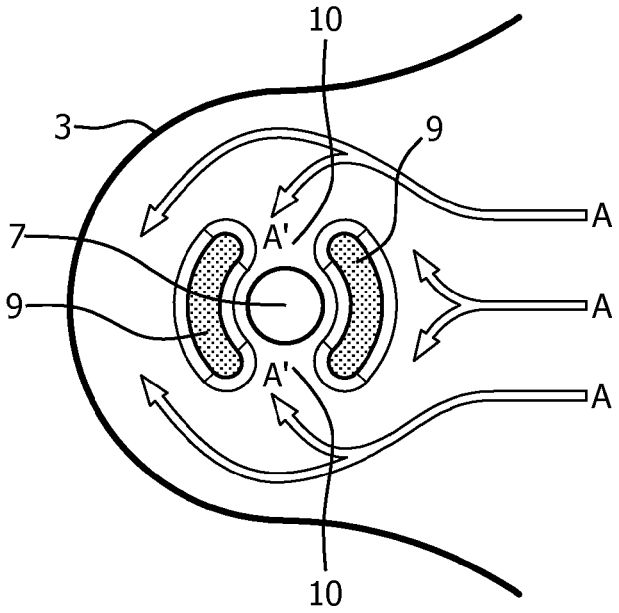
FIG. 3 shows a plan view of a portion of a steam channel showing a vent and baffles surrounding the vent to re-direct steam into multiple flow paths that converge on the vent from opposite directions, according to an embodiment of the invention.

With reference to the embodiment of the invention shown by FIG. 3, there is a plan view of the steam channel 6 in which steam is flowing, in direction 'A'. A single vent 7 is shown, which is partially surrounded by a pair of arc-shaped baffles 9 which effectively combine together to close off a region surrounding the upper end of the vent 7, apart from two opposing gaps 10 between the ends of each baffle 9 that provides steam entry points into said region above the vent 7, as shown by arrows 'A'.

Figure 4:
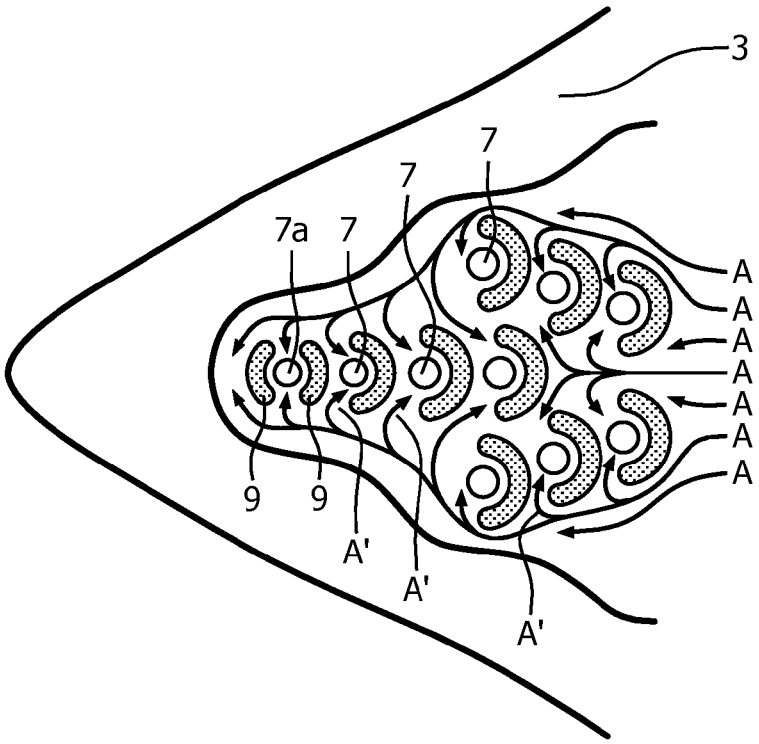
FIG. 4 shows a top plan view of a steam channel showing multiple vents and a baffle associated with each vent, according to an embodiment of the invention.

FIG. 4 shows another embodiment according to the invention. In this embodiment, a single arc-shaped baffle 9 surrounds each vent 7, apart from the leading vent 7*a*, which is similar to that shown with reference to FIG. 3. The single baffle 9 surrounding each vent 7 is positioned so that it is between the vent 7 and the direction of incoming steam, so that the steam impinges on the baffle 9 and is directed around it. Again, this results in the steam approaching the vent 7 in separate flows from different directions. These flows collide and reconverge above a vent 7 resulting in a reduction or cancellation of the velocity components in a direction of steam flow in the steam channel 6.

Figure 5:
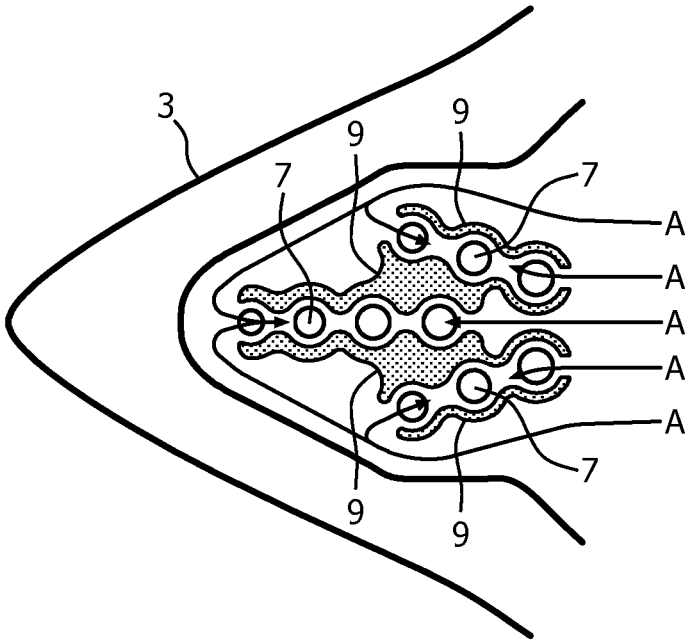
FIG. 5 shows a top plan view of a steam channel showing multiple vents and a baffle associated with groups of vents, according to another embodiment of the invention.

In another embodiment of the invention, as shown in FIG. 5, a group or set of vents 7 is surrounded by a baffle 9. In FIG. 5, each group of vents 7 is arranged linearly and an opening is formed in the baffle 9 at each end so that the steam enters the region above the group of vents 7 from opposite directions and from each end. The baffles 9 surrounding each group of vents 7 may have a wavy profile so that they narrow between the vents 7 in order to regulate the separate flows of steam.

Figure 6:
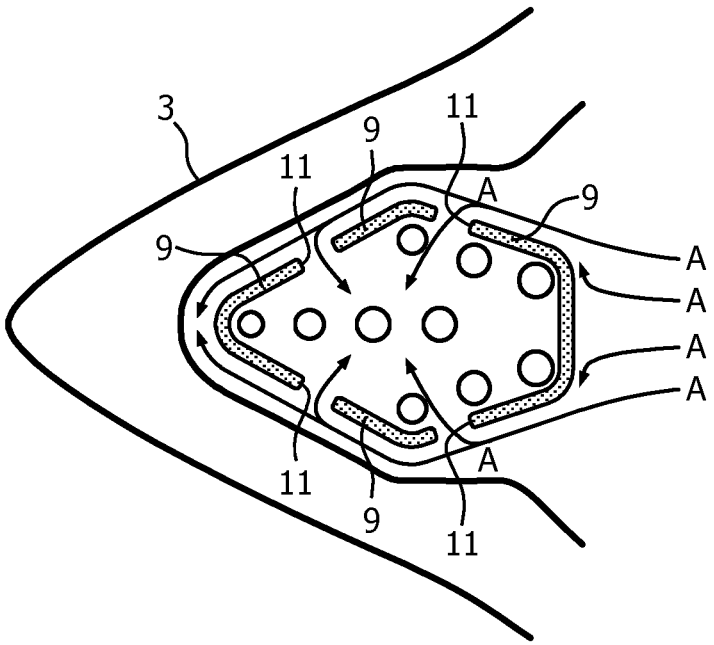
FIG. 6 shows a top plan view of a steam channel showing multiple vents and a baffle surrounding the vents, according to another embodiment of the invention.

In the embodiment of the invention shown in FIG. 6, a peripheral baffle 9 surrounds the vents 7. Intermittent breaks 11 divide the peripheral baffle 9 up into individual sections so that steam can pass around the baffle 9 and through the breaks 11 and towards the vents 7.

Figure 7:
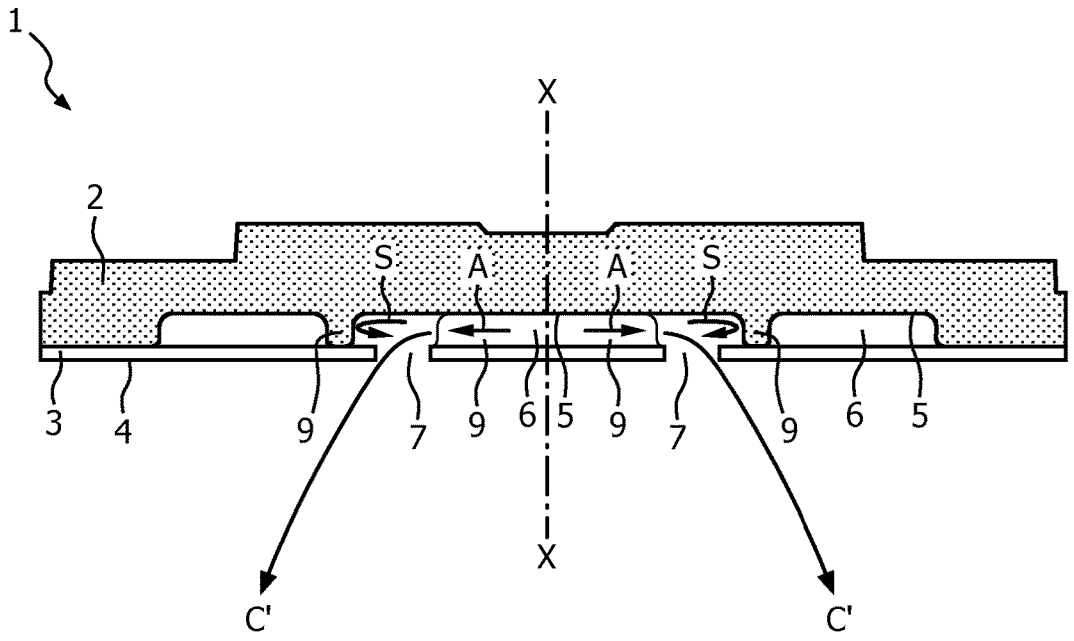
FIG. 7 shows a side elevation of a sole plate according to another embodiment according to the invention.

FIG. 7 shows another embodiment of the invention. In this embodiment, baffles 9 are still provided in the recess 5 to control the flow of steam to the vents 7, although the intention here is that the flow is controlled by the baffles 9 so that a velocity component in a horizontal direction, i.e. in a direction parallel to the ironing surface 3 still remains when the converging flow paths meet over a vent 7. This can be achieved by, for example, making one of the opposing gaps 10 between the baffle sections 9 smaller than the other so that there is a greater flow through one gap 10 than through the other gap. As a result, unequal flows of steam, or flows of unequal intensity, converge over a vent 7, which results in a reduction in the horizontal velocity component in the steam channel but does not result in a complete balanced cancellation of the horizontal velocity component. The jet of steam will therefore exit the vents 7 with a directionality that is less than 90 degrees relative to the ironing surface 4, i.e. at an angle of between 60 to 90 degrees relative to the ironing surface. By controlling the spacing and sizing of the baffles 9 that surround different vents 7, the flow of steam exiting the vents 7 can be controlled so that it flows in a predetermined direction. As shown in FIG. 7, the steam jet 'C' coming out from the left hand vent 7 does so at a first angle of between 60 to 90 degrees that is directed away from a centre line X-X, and the steam jet 'C' coming out from the right hand vent 7 does so at a second angle of between 60 to 90 degrees, also directed away from the centre line X-X.

As shown in FIG. 7, the majority of the steam flowing along the steam channel 6, as indicated by arrow 'A' does not impinge against a baffle 9, but passes directly towards and through a vent 7 as the main flow of steam. However, a remainder or secondary flow 'S' of steam flows continues to flow within the steam channel 6 over the vent 7 and impinges against a baffle 9 positioned beyond the vent 7 so that the secondary flow 'S' is reversed in direction by the baffle 9 before it also passes through the vent 7. As the main flow 'A' is of a stronger intensity than the secondary flow 'S', the horizontal component of flow is not completely balanced or cancelled out and the resultant direction of flow of steam out of the vent 7 is controlled so that it flows at an angle of approximately 60 to 90 degrees relative to the ironing surface 4.

In accordance with any of the above-described embodiments of the invention, the baffles 9 can be formed as part of the sole plate assembly 1 and can extend from either the sole plate 2 or the ironing plate 3. Conceivably, the baffles 9 could be a separate component that is received in the steam channel 6 and is sandwiched between the sole plate 2 and the ironing plate 3. If the baffles 9 extend towards either the sole plate 1 or the ironing plate 3, a seal may be provided to ensure that there is no escape of steam over the top of the baffles 9. The seal may take the form of an adhesive sealant (e.g. silicone sealant) or an elastomeric gasket.

The seals and/or the baffles may be made of metal, ceramic, polymer or elastomeric material.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A garment steaming appliance comprising a sole plate assembly comprising:
- an ironing plate comprising:
  - an ironing surface; and
  - an opposing upper surface, and
- a steam channel, extending along the upper surface of the ironing plate, configured to:
  - receive a flow of steam, and
  - direct said received flow of steam in a direction substantially parallel to the ironing surface, and
- a vent extending through said ironing plate from said upper surface to said ironing surface, and
- a baffle in said steam channel, partially surrounding said vent, said baffle configured to:
  - divide the flow of steam into multiple flow paths that converge above said vent from different directions along said upper surface to control the direction of the resultant flow of steam out of said vent relative to said ironing surface.

2. The garment steaming appliance according to claim 1, wherein the steam channel is configured to:
- the direction of the resultant flow of steam is substantially perpendicular relative to the ironing surface.

3. The garment steaming appliance according to claim 1, wherein said baffle is configured to:
- divide the flow of steam into two separate flow paths that converge on said vent from opposite directions.

4. The garment steaming appliance according to claim 3, wherein said baffle is configured to:
- divide the flow of steam into separate flow paths so that the resultant velocity component of the steam when the separate flow paths converge is substantially zero.

5. The garment steaming appliance according to claim 1, wherein said baffle comprises:
- separate sections being spaced from each other and surrounding said vent.

6. The garment steaming appliance according to claim 5, wherein at least one of said sections is arc-shaped.

7. The garment steaming appliance according to claim 1, comprising:
- a plurality of vents and a separate baffle associated with each of said plurality of vents.

8. The garment steaming appliance according to claim 1, comprising:
- a plurality of vents and a baffle associated with a group of said plurality of vents.

9. The garment steaming appliance according to claim 1, wherein the sole plate assembly comprises:
- a sole plate extending over the ironing plate, the steam channel being formed within a recess in said sole plate.

10. The garment steaming appliance according to claim 9, wherein the sole plate and the ironing plate are one of: integrally formed together and attachable to each other.

11. The garment steaming appliance according to claim 9, wherein the baffles are located in the recess between the sole plate and the ironing plate.

12. The garment steaming appliance according to claim 11, wherein the baffles are integral with one of: the sole plate and the ironing plate.

13. The garment steaming appliance according to claim 11, wherein the baffles are integral with the sole plate; and a seal is formed between the baffles and the ironing plate.

14. The garment steaming appliance according to claim 11, wherein the baffles are integral with the ironing plates; and a seal is formed between the baffles and the sole plate.

* * * * *